US005931828A

United States Patent [19]

Durkee

[11] Patent Number: 5,931,828

[45] Date of Patent: Aug. 3, 1999

[54] RECLOSABLE VIAL CLOSURE

[75] Inventor: Jeffrey W. Durkee, Bradenton, Fla.

[73] Assignee: The West Company, Incorporated, Lionville, Pa.

[21] Appl. No.: 08/706,500

[22] Filed: Sep. 4, 1996

[51] Int. Cl.[6] ..... A61B 19/00

[52] U.S. Cl. ..... 604/403; 215/247; 215/306

[58] Field of Search ..... 604/403–407; 215/251, 247, 249, 306, 272, 237–239, 244, 248

[56] References Cited

U.S. PATENT DOCUMENTS

| | | |
|---|---|---|
| 4,227,617 | 10/1980 | Albrecht et al. . |
| 4,437,574 | 3/1984 | Ruklic . |
| 4,516,684 | 5/1985 | Walter . |
| 4,562,932 | 1/1986 | Finnern . |
| 5,088,612 | 2/1992 | Storar et al. . |
| 5,145,646 | 9/1992 | Tyranski . |
| 5,147,054 | 9/1992 | Pehr . |
| 5,368,177 | 11/1994 | Derksen . |
| 5,405,031 | 4/1995 | Derksen . |
| 5,429,256 | 7/1995 | Kestenbaum . |
| 5,447,247 | 9/1995 | Derksen . |
| 5,464,112 | 11/1995 | Guillot . |

*Primary Examiner*—John G. Weiss
*Assistant Examiner*—Ki Yong O
*Attorney, Agent, or Firm*—Panitch Schwarze Jacobs & Nadel, P.C.

[57] ABSTRACT

A reclosable closure for a vial having a neck portion with a sealing flange surrounding an open end thereof is provided. The reclosable closure comprises a metal shell, having a top portion with an opening defined therethrough, and a depending side wall portion sized to engage the flange of the vial. A plastic top is provided having a top portion which overlies the top portion of the metal shell and surrounds the opening and which has an aperture defined therethrough aligned with the opening. The plastic top has an outer skirt which overlies the depending side wall portion of the metal shell, and an inner wall which depends from the top portion of the plastic top around the aperture. The inner wall has a first portion which extends through the opening, and a second portion which extends outwardly from the first portion to secure the plastic top to the metal shell. A reclosable cover is rotatably attached to the top by an integral hinge for rotation about a hinge axis. The cover is rotatable on the hinge between a first, closed position, where the cover overlies the top portion of the plastic top and the aperture, and a second, open position, in which the aperture is exposed.

19 Claims, 1 Drawing Sheet

RECLOSABLE VIAL CLOSURE

FIELD OF THE INVENTION

The present invention relates to a vial closure, and more particularly, to a reclosable closure for a vial to cover the target area of a reusable vial between use.

BACKGROUND OF THE INVENTION

Known medical vials containing medicaments and serums for injection include a pierceable seal which extends across the open top of the vial. The seal is generally held in position by a metallic shell which is crimped to the neck of the vial and covers the open end. The metallic shell has a break away section located over the target area of the seal. In order to provide an indicator for product tampering as well as a gripping surface for removing the breakaway section of the metallic shell, a plastic cap is attached to the metallic shell, and covers the target area. The plastic cap is removed along with a breakaway section of the aluminum collar or shell to expose the target area.

However, for vials which contain multiple doses of a medicament or serum, such as insulin or heparin, it would be desirable to re-cover the exposed target area of the seal between use, in order to minimize exposure of the target area to dust, debris or other contaminants, while the vial is being stored.

One proposed solution to this problem is an all plastic vial cap having a reclosable cover hingedly attached to the cap which is press fit onto the neck of a vial to hold a sealing disk in position. The reclosable cover can be used to protect the target area of the sealing disk. However, this cap requires extremely close tolerances between the neck of the bottle and the inside of the cap, which are difficult to maintain with glass vials without expensive tooling, which increases the manufacturing cost. If the close tolerances are not maintained, the vial caps can leak. This can result in contamination of the medicament or serum located in the vial, as well as toxicity to non-patients who handle the vial which has the leaked medicament or serum on its outer surface.

In another known container, a closure is provided with a flanged aluminum cap which holds the sealing element over the mouth of the bottle. The cap includes a central tear-out section. A cover is attached to the cap, with the front part of the cover being attached to the tear-out section of the cap by a projection which extends in a form-locked manner through a mating opening in the tear-out section. The rear part of the cover is affixed to a second part of the cap through a projection which extends in a form-locked manner through a second opening in the cap. The front part of the cover hinges about an articulation between the front and rear parts, and can be fastened to the rear part with a snap fastener element. However, after being opened, the cover can only be reclosed in a provisional manner by reclosing the front part with the attached tear-out section. Further tear-out lines are provided, which extend around the rear part of the cover such that the cover can be pulled by a user to tear through the edge of the aluminum cap to remove the entire closure from the bottle. However, if the vial is to be reused, this closure does not provide a secure means for reclosing the cover, and once the initial tear-out section is removed, the torn-out section is exposed on the cover each time the cover is opened.

The present invention is designed to provide a reclosable vial which provides sealing integrity not offered by the known all-plastic vial closures having reclosable covers.

SUMMARY OF THE INVENTION

Briefly stated, the present invention is a reclosable closure for a vial having a neck portion with a sealing flange surrounding an open end thereof. The reclosable closure comprises a metal shell, having a top portion with an opening defined therethrough, and a depending side wall portion sized to engage the flange of the vial. A plastic top is provided having a top portion which overlies the top portion of the metal shell and surrounds the opening and which has an aperture defined therethrough aligned with the opening. The plastic top is attached to the metal shell. A reclosable cover is rotatably attached to the top by an integral hinge for rotation about a hinge axis. The cover is rotatable on the hinge between a first, closed position, where the cover overlies the top portion of the plastic top and the aperture, and a second, open position, in which the aperture is exposed.

In another aspect, the present invention provides a reclosable closure for a vial having a neck portion with a sealing flange surrounding an open end thereof. The reclosable closure comprises a metal shell, having a top portion with an opening defined therethrough, and a depending side wall portion sized to engage the flange of the vial. A plastic top is provided having a top portion which overlies the top portion of the metal shell and surrounds the opening and which has an aperture defined therethrough aligned with the opening. The plastic top has an outer skirt which overlies the depending side wall portion of the metal shell, and an inner wall which depends from the top portion of the plastic top around the aperture. The inner wall has a first portion which extends through the opening, and a second portion which extends outwardly from the first portion to secure the plastic top to the metal shell. A reclosable cover is rotatably attached to the top by an integral hinge for rotation about a hinge axis. At least one resilient portion is connected between the top and the cover in proximity to the hinge. The resilient portion has an undeformed configuration which lies on a first side of the hinge axis. The resilient portion is elastically deformable as the cover is rotated from a first, closed position, where the cover overlies the aperture in the top, to a second, open position, in which the aperture in the top is exposed, such that the cover is drawn to the open position by spring back of the elastic deformation of the resilient portion as at least a part of the resilient portion moves past the axis of the hinge.

BRIEF DESCRIPTION OF THE DRAWING

The foregoing summary, as well as the following detailed description of preferred embodiments of the invention, will be better understood when read in conjunction with the appended drawing. For the purpose of illustrating the invention, there is shown in the drawing an embodiment which is presently preferred. It should be understood, however, that the invention is not limited to the precise arrangements and instrumentalities shown. In the drawing.

DETAILED DESCRIPTION OF THE PREFERRED EMBODIMENT

Figure 1:
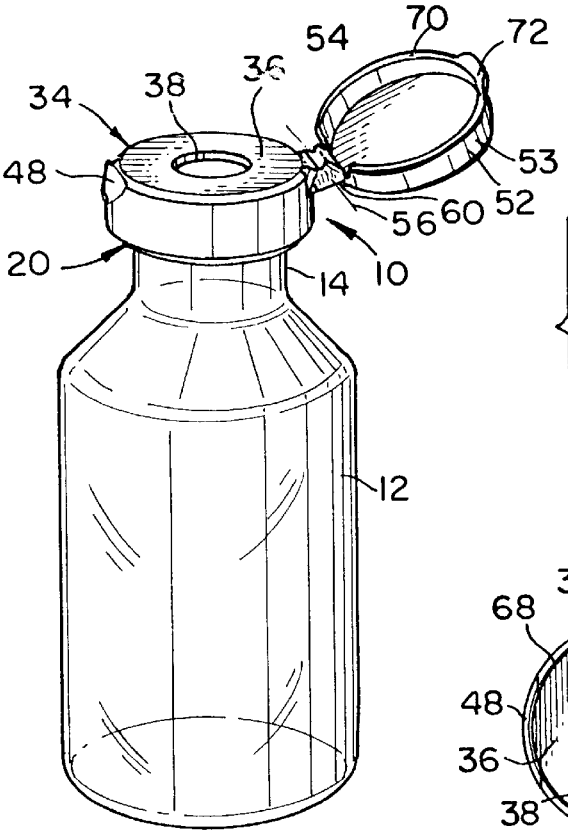
FIG. 1 is a perspective view of a reclosable closure in accordance with the present invention.

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the reclosable closure and designated parts thereof. The terminology includes the words above specifically mentioned, derivatives thereof and words of similar import.

Figure 4:
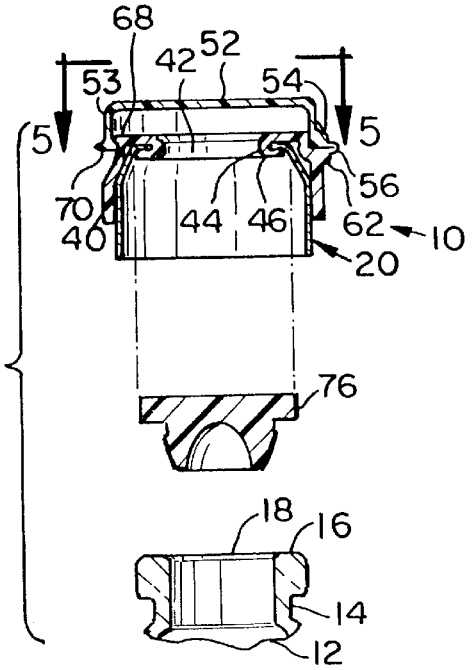
FIG. 4 is a cross-sectional view of the reclosable closure in accordance with the present invention being installed on the neck of a vial.
Figure 6:
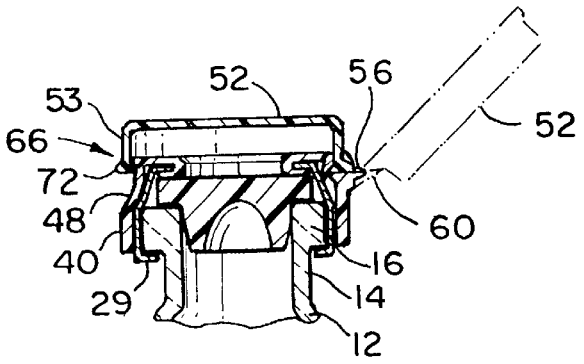
FIG. 6 is a cross-sectional view, similar to FIG. 4, showing the reclosable closure installed on the neck of a vial.

Referring to the drawings, wherein like numerals indicate like elements throughout, there is shown a reclosable closure 10 for a vial 12 in accordance with the present invention. Preferably, the vial 12 has a neck portion 14 with a sealing flange 16 surrounding an open end 18 thereof, as shown in FIGS. 4 and 6. While the present invention is preferably for use with a vial, it is understood by those skilled in the art from the present disclosure that the reclosable closure 10 could be used in conjunction with any type of container for a medicament having a neck.

Referring now to FIGS. 1, 2, 4 and 6, the reclosable closure 10 comprises a metal shell 20 having a top portion 22 with an opening 24 defined therethrough, and a depending side wall portion 28 sized to engage the flange 16 of the vial 12. In the preferred embodiment, the metal shell 20 is made of aluminum, and is crimped to the neck 16 of the vial 12 to form a crimped portion 29, as shown in FIG. 6. However, it will be recognized by those skilled in the art from the present disclosure that the metal shell 20 could be made from another suitable material, such as stainless steel, or any other suitable metallic material. Additionally, the opening 24 preferably includes a formed lip 30. However, it will be recognized by the skilled artisan from the present disclosure that the formed lip 30 is not required.

Figure 2:
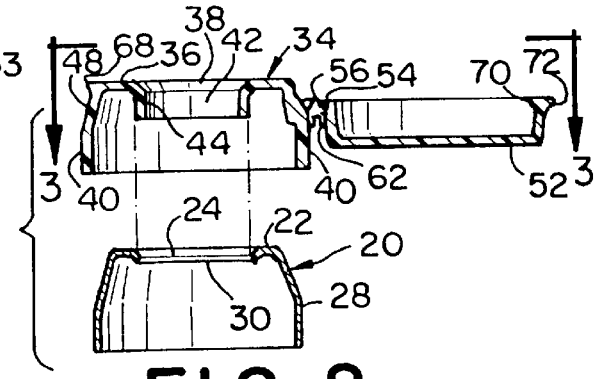
FIG. 2 is a partially disassembled cross-sectional view of the reclosable closure in accordance with the present invention.

Still with reference to FIGS. 1, 2 and 4, a plastic top 34 is provided having a top portion 36 which overlies the top portion 22 of the metal shell 20 and surrounds the opening 24. The top portion 36 of the plastic top 34 includes an aperture 38 defined therethrough which is aligned with the opening 24 in the metal shell 20. The plastic top includes an outer skirt 40 which overlies the depending side wall portion 28 of the metal shell 20. The plastic top 34 also includes an inner wall 42 which depends from the top portion 36 of the plastic top 34 around the aperture 38. The inner wall 42 has a first portion 44 which extends through the opening 24 in the metal shell 20. Preferably, the opening 24 in the metal shell 20 is circular, and the inner wall 42 is annular, and the outside diameter of the inner wall 42 of the plastic top 34 is less than the inside diameter of the opening 24 in the metal shell 20.

A second portion 46 of the inner wall 42 extends outwardly from the first portion sufficiently to secure the plastic top 34 to the metal shell 20, as shown in FIG. 4. Preferably, the second portion 46 of the inner wall 42 is formed by hot melt upset or heat staking of the free end of the inner wall 42 during assembly of the plastic cover 34 and the metal shell 20. See FIG. 2, which illustrates the plastic top 34 being assembled to the metal shell 20, and FIG. 4, which shows the assembled plastic top 34 and metal shell 20 with the second portion 46 of the inner wall 42 heat staked or hot melt upset to secure the plastic top 34 to the metal shell 20.

It will be recognized by those skilled in the art from the present disclosure that other suitable means for deforming the second portion 46 of the inner wall 42 to a size greater than the size of the opening 24 in the metal shell 20, such as punching or plastically deforming, may be utilized, if desired. It will be similarly recognized that the plastic top 34 can be attached to the metal shell 20 through other means, such as bonding or an adhesive connection, or a "snap" or interference fit between the plastic top 34 and the metal shell 20. For example, the inner wall 42 could be omitted and the plastic top 34 hot bonded to the metal shell 20, or the second portion 46 of the inner wall could snap into the opening 42 in the metal shell 20.

Preferably, the plastic top 34 includes a recessed portion 48 on one side thereof. The plastic cover 34 is preferably made from a polypropylene material. However, it will be understood by those skilled in the art from the present disclosure that any other suitable plastic or polymeric material may be used, if desired.

A reclosable, plastic cover 52 is rotatably attached to the plastic top 34 by a hinge 54 for rotation about a hinge axis 56. The cover 52 is rotatable on the hinge between a first, closed position, in which the cover 52 overlies the top portion 36 of the plastic top 34 and the aperture 38, and a second, open position, in which the aperture 38 is exposed. Preferably, the hinge 54 is a living hinge which is integrally formed with the plastic top 34, and the cover 52 and the plastic top 34 are formed as a unitary structure.

Figure 3:
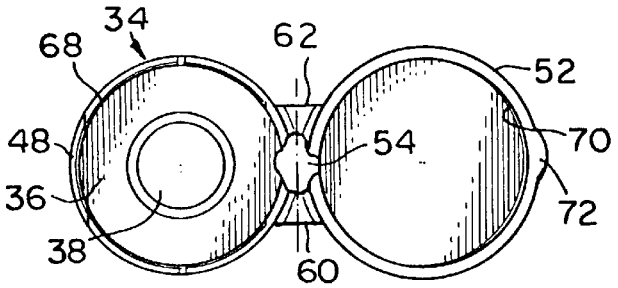
FIG. 3 is a top plan view taken along line 3—3 in FIG. 2.
Figure 5:
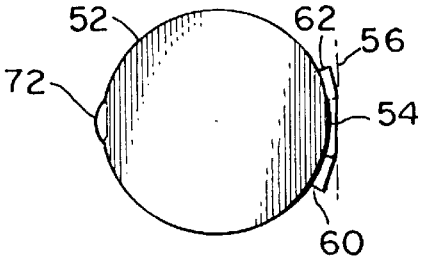
FIG. 5 is a top view taken along line 5—5 in FIG. 4.

Referring now to FIGS. 1, 3 and 5, at least one resilient portion 60 is preferably connected between the plastic top 34 and the cover 52 in proximity to the hinge 54. In the presently preferred embodiment, two resilient portions 60, 62 are provided, with one resilient portion 60, 62 being located on each side of the hinge 54. Each resilient portion 60, 62 has an undeformed configuration which lies off the hinge axis when the reclosable, plastic cover 52 is in the open or closed configuration, as shown in FIGS. 4–6. Each resilient portion 60, 62 is elastically deformable as the cover 52 is rotated from the first, closed position, in which each resilient portion 60, 62 lies on a first side of the hinge axis 56, to the second, open position, as shown in phantom in FIG. 6, in which the aperture 38 in the plastic top 34 is exposed. The cover 52 is drawn to the open position by spring back of the elastic deformation of the resilient portions 60, 62 as at least a part of the resilient portions 60, 62 move from the first side of the hinge axis 56 to the opposite side of the hinge axis 56, as shown in phantom in FIG. 6.

The resilient portions 60, 62 are also elastically deformable as the cover 52 is rotated from the second, open position, as shown in phantom in FIG. 6, to the first, closed position, such that the cover 52 is drawn to the closed position by spring back of the elastic deformation of the resilient portions 60, 62 as the resilient portions 60, 62 move past the hinge axis 56.

Preferably, the resilient portions 60, 62 are integrally formed of a polypropylene material with the cover 52, the hinge 54 and the plastic top 34, and a resilient portion 60, 62 is located on each side of the hinge 54. Each resilient portion 60, 62 is preferably comprised of a thin web of material which extends between the outer skirt 40 of the plastic top 34 and the cover 52. However, it will be recognized by those skilled in the art from the present disclosure that a single resilient portion could be used, and the resilient portions 60, 62 could be one or more separate, elastically deformable pieces made of a suitable material, which are attached between the plastic cap 34 and the cover 52.

In the preferred embodiment, the reclosable closure 10 includes a latch 66 on an opposite side of the reclosable plastic cover 52 from the hinge 54. Preferably, the latch 66 comprises a lip 68, as shown in FIG. 2, located around the periphery of the plastic top 34, and a detent 70, located on an inner part of the side wall 53 of the cover 52. Preferably, a finger catch 72 is also provided on the cover 52 in a position opposite to the hinge 54, aligned with the recess 48 on the plastic top 34. However, it will be recognized by those skilled in the art from the present disclosure that the lip 68 could be located on the cover 52 and the detent 70 could be located on the plastic top 34, if desired.

Referring to FIGS. 4 and 6, preferably a pierceable sealing element 76 is located inside the metal shell 20, adjacent to the sealing flange 16 on the vial to seal the open end 18 of the vial 12.

The assembly of the reclosable vial will now be described with reference to FIGS. 2, 4 and 6. As shown in FIG. 2, preferably the plastic top 34 is joined with the metal sleeve 20 by placing the plastic top 34 over the metal sleeve such that the inner wall 42 of the plastic top 34 extends through the opening 24 in the metal sleeve 20. As shown in FIG. 4, the second portion 46 of the inner wall 42 is formed preferably by heat staking or hot-melt upset of the free end of the inner wall 42 such that the second portion 46 extends outwardly from the first portion 44 to secure the plastic top 34 to the metal shell 20. The cover 52 is closed by rotating the cover 52 about the hinge axis 56 to the closed position, where the detent 70 on the cover engages the lip 68 on the plastic top 34.

Still with reference to FIG. 4, the resilient sealing element 76, such as a conventional stopper, is positioned in the open end 18 of the vial 12, and the reclosable closure 10 is positioned over the sealing element 76. The depending side wall portion 28 is then crimped around the sealing flange 16 on the neck 14 of the vial 12, as shown in FIG. 6. The crimped portion 29 of the depending side wall portion 28 retains the reclosable closure 10 to the vial 12 in a tamper-evident manner. The reclosable closure 10 can be covered with a tamper evident band (not shown), such as a polystyrene band (not shown) in order to provide tamper evidency for the cover 52, if desired.

The reclosable plastic cover 52 can be moved from the closed position by the user applying pressure to the finger catch 72 such that the detent 70 on the cover 52 is disengaged from the lip 68 on the periphery of the top portion 36 of the plastic top 34. Parts of the resilient portions 60, 62, the halves attached to the cover 52, are moved with the cover 52 from the first side of the hinge axis 56, as shown in FIG. 5, and are elastically deformed as the cover is opened. The parts of the resilient portions 60, 62 attached to the cover 52 move from the first side of the hinge axis 56 toward a position in line with the hinge axis 56. As the cover 52 moves further open, those parts of the resilient portions 60, 62 pass through an aligned position with the hinge axis 56, and move to the opposite side of the hinge axis 56, as shown in phantom in FIG. 6. The cover 52 is drawn to the open position by spring back of the elastic deformation of the resilient portions 60, 62.

In order to close the cover 52, pressure is exerted on the cover 52 to elastically deform the resilient portions 60, 62 as the cover 52 is rotated from the second, open position, as shown in phantom in FIG. 6, toward the first, closed position. As the resilient portions 60, 62 pass the aligned position with the hinge axis 56, the cover 52 is drawn to the closed position by spring back of the elastic deformation of the resilient portions 60, 62.

In the preferred embodiment, the resilient portions 60, 62 draw the cover 52 to a nearly closed position. However, the cover 52 must be snapped down by pressing downwardly on the cover 52 such that the detent 70 on the cover 52 deflects over the lip 68 on the plastic top 34 to latch the cover 52 in the closed position. Additionally, in the preferred embodiment, the resilient portions 60, 62 hold the cover 52 in an open position which is rotated approximately 120°–150° from the closed position. However, those skilled in the art will recognize that the angle at which the cover is held in the open position can be varied by adjusting the size of the resilient portions 60, 62.

A user can use the vial by opening the cover 52 and piercing the sealing element 76 with a hypodermic needle, canula or other septa penetrating device, to withdraw a medicament from the vial 12. The cover 52 can then be closed to prevent dust or other contaminants from collecting on the target area of the sealing element 76 which is exposed through the aperture 38 in the plastic top 34.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A reclosable closure in combination with a medical container, the having a neck portion with a sealing flange surrounding an open end thereof, the reclosable closure in combination with the medical container comprising:

a metal shell having a top portion with an opening defined therethrough and a depending sidewall portion sized to engage the flange of the medical container;

a plastic top having a top portion which overlies the top portion of the metal shell and surrounds the opening and which has an aperture defined therethrough aligned with the opening, the plastic top non-removably attached to the metal shell;

a reclosable, plastic cover rotatably attached to the plastic top by a hinge for rotation about a hinge axis, the cover being rotatable between a first, closed position, where the cover overlies the top portion of the plastic top and the aperture, and a second, open position, in which the aperture is exposed; and the reclosable closure being mounted on the medical container.

2. The reclosable closure of claim 1 wherein the top portion of the plastic top includes an outer skirt which overlies the depending sidewall portion of the metal shell and an inner wall which depends from the top portion of the plastic top around the aperture, the inner wall having a first portion which extends through the opening in the metal shell, and a second portion which extends outwardly from the first portion sufficiently to secure the plastic top to the metal shell.

3. The reclosable closure of claim 2 wherein the inner wall is annular, and the second portion of the inner wall is deformed to a size greater than the opening to secure the plastic top to the metal shell.

4. The reclosable closure of claim 3 wherein the second portion of the inner wall is deformed by hot melt upset.

5. The reclosable closure of claim 1 further comprising at least one resilient portion connected between the plastic top and the cover in proximity to the hinge, the resilient portion having an undeformed configuration which lies on a first side of the hinge axis, the resilient portion being elastically deformable as the cover is rotated from the first, closed position to the second, open position, such that the cover is drawn to the open position by spring back of the elastic deformation of the resilient portion as at least a part of the resilient portion moves from the first side of the hinge axis to an opposite side of the hinge axis.

6. The reclosable closure of claim 5 wherein the resilient portion is integrally formed with the cover and the top.

7. The reclosable closure of claim 5 wherein the resilient portion is elastically deformable as the cover is rotated from the second, open position to the first, closed position, such that the cover is drawn to the closed position by spring back of the elastic deformation of the resilient portion as the resilient portion moves past the hinge axis.

8. The reclosable closure of claim 1 wherein a latch is provided on an opposite side of the reclosable, plastic cover from the hinge.

9. The reclosable closure of claim 8 wherein the latch comprises a lip located on one of the plastic top and the cover, and a detent located on a remaining one of the plastic top and the cover.

10. The reclosable closure of claim 1 further comprising a pierceable sealing element located inside the metal shell.

11. A reclosable closure for a vial having a neck portion with a sealing flange surrounding an open end thereof, the reclosable closure comprising:

a metal shell having a top portion with an opening defined therethrough and a depending sidewall portion sized to engage the flange of the vial;

a plastic top having a top portion which overlies the top portion of the metal shell and surrounds the opening in the metal shell and which has an aperture defined therethrough aligned with the opening in the metal shell, an outer skirt which overlies the depending sidewall portion of the metal shell and an annular inner wall which depends from the top portion of the plastic top around the aperture, the inner wall having a first portion which extends through the opening, and a second portion which extends outwardly from the first portion sufficiently to secure the plastic top to the metal shell;

a reclosable, plastic cover rotatably attached to the plastic top by a hinge for rotation about a hinge axis; and at least one resilient portion connected between the plastic top and the cover in proximity to the hinge, the resilient portion having an undeformed configuration which lies on a first side of the hinge axis, the resilient portion being elastically deformable as the cover is rotated from a first, closed position, where the cover overlies the top portion of the plastic top and the aperture and the resilient portion lies on a first side of the hinge axis, to a second, open position, in which the aperture in the plastic top is exposed, such that the cover is drawn to the open position by spring back of the elastic deformation of the resilient portion as at least a part of the resilient portion moves from the first side of the hinge axis to an opposite side of the hinge axis.

12. The reclosable closure of claim 11 wherein the second portion of the inner wall is formed by hot melt upset.

13. The reclosable closure of claim 11 wherein the resilient portion is integrally formed with the cover and the top.

14. The reclosable closure of claim 11 wherein the resilient portion is elastically deformable as the cover is rotated from the second, open position to the first, closed position, such that the cover is drawn to the closed position by spring back of the elastic deformation of the resilient portion as the resilient portion moves past the hinge axis.

15. The reclosable closure of claim 11 wherein a latch is provided on an opposite side of the reclosable, plastic cover from the hinge.

16. The reclosable closure of claim 15 wherein the latch comprises a lip located on one of the plastic top and the cover, and a detent located on a remaining one of the plastic top and the cover.

17. The reclosable closure of claim 11 further comprising a pierceable sealing element located inside the metal shell, adjacent to the sealing flange.

18. The reclosable closure of claim 17 wherein the depending sidewall portion of the metal shell is crimped to the sealing flange of the vial.

19. A reclosable closure in combination with a vial, the vial having a neck portion with a sealing flange surrounding an open end thereof, the reclosable closure in combination with the vial comprising:

a metal shell having a top portion with an opening defined therethrough and a depending sidewall portion sized to engage the flange of the vial;

a plastic top having a top portion which overlies the top portion of the metal shell and surrounds the opening and which has an aperture defined therethrough aligned with the opening, the plastic top non-removably attached to the metal shell;

a reclosable, plastic cover rotatably attached to the plastic top by a hinge for rotation about a hinge axis, the cover being rotatable between a first, closed position, where the cover overlies the top portion of the plastic top and the aperture, and a second, open position, in which the aperture is exposed; and the reclosable closure being mounted on the vial.

* * * * *